US011866890B2

(12) United States Patent
Lull et al.

(10) Patent No.: US 11,866,890 B2
(45) Date of Patent: Jan. 9, 2024

(54) MOBILE EARTH WORKING MACHINE ENCOMPASSING A FUNCTIONAL APPARATUS PREFERABLY TOOLLESSLY COUPLED DETACHABLY TO A MACHINE FRAME

(71) Applicant: Wirtgen GmbH, Windhagen (DE)

(72) Inventors: Roland Lull, Königswinter (DE); Marcel Joisten, Neuwied (DE); Oliver Freund, Königswinter (DE)

(73) Assignee: Wirtgen GmbH

( * ) Notice: Subject to any disclaimer, the term of this patent is extended or adjusted under 35 U.S.C. 154(b) by 357 days.

(21) Appl. No.: 17/094,378

(22) Filed: Nov. 10, 2020

(65) Prior Publication Data

US 2021/0172132 A1 Jun. 10, 2021

(30) Foreign Application Priority Data

Dec. 6, 2019 (DE) ..... 10 2019 133 444.6

(51) Int. Cl.
*E01C 23/088* (2006.01)

(52) U.S. Cl.
CPC ..... *E01C 23/088* (2013.01)

(58) Field of Classification Search
CPC ..... E01C 23/088; E01C 23/127
See application file for complete search history.

(56) References Cited

U.S. PATENT DOCUMENTS

| | | | | |
|---|---|---|---|---|
| 4,647,248 | A * | 3/1987 | Wirtgen | E01C 23/088 404/90 |
| 4,834,463 | A * | 5/1989 | Nye | E01C 23/088 404/90 |
| 6,076,895 | A | 6/2000 | Ino et al. | |
| 6,923,508 | B2 | 8/2005 | Holl et al. | |
| 8,388,070 | B2 | 3/2013 | Von Schnebeck et al. | |
| 8,622,480 | B2 | 1/2014 | Weckerly et al. | |
| 10,174,465 | B2 | 1/2019 | Steeg et al. | |
| 10,190,270 | B2 | 1/2019 | Hirman | |
| 10,421,489 | B2 | 9/2019 | Held et al. | |
| 10,519,613 | B2 | 12/2019 | Steeg et al. | |
| 10,590,612 | B2 | 3/2020 | Frankemölle et al. | |

(Continued)

FOREIGN PATENT DOCUMENTS

| | | |
|---|---|---|
| CN | 102605705 A | 7/2012 |
| CN | 104631294 A | 5/2015 |

(Continued)

OTHER PUBLICATIONS

European Search Report for corresponding patent application No. EP 20211156.3, dated May 10, 2021, 9 pages (not prior art).

(Continued)

*Primary Examiner* — Janine M Kreck
(74) *Attorney, Agent, or Firm* — Lucian Wayne Beavers; Patterson Intellectual Property Law, PC

(57) ABSTRACT

A mobile earth working machine includes a machine frame; a working apparatus; a functional apparatus connected to the machine frame pivotably; and a pivot joint between the machine frame and the functional apparatus, having a frame-associated joint element and an apparatus-associated joint element. A mechanical coupling includes a frame-side coupling configuration and an apparatus-side counterpart coupling configuration.

15 Claims, 9 Drawing Sheets

(56) References Cited

U.S. PATENT DOCUMENTS

| | | | | |
|---|---|---|---|---|
| 11,142,876 | B2 * | 10/2021 | Hirman | E01C 23/088 |
| 2004/0075330 | A1 | 4/2004 | Holl et al. | |
| 2005/0058507 | A1 * | 3/2005 | Musil | E01C 19/48 404/108 |
| 2010/0237681 | A1 | 9/2010 | Von Schonebeck et al. | |
| 2013/0187437 | A1 | 7/2013 | Von Schonebeck et al. | |
| 2016/0186390 | A1 | 6/2016 | Bippen et al. | |
| 2017/0130406 | A1 | 5/2017 | Steeg et al. | |
| 2018/0215595 | A1 | 8/2018 | Koppelaar et al. | |
| 2019/0136469 | A1 | 5/2019 | Steeg et al. | |

FOREIGN PATENT DOCUMENTS

| | | | | |
|---|---|---|---|---|
| CN | 106677039 | A | 5/2017 | |
| CN | 214401349 | U | 10/2021 | |
| DE | 202009003824 | U1 | 9/2010 | |
| DE | 102016208246 | A1 | 11/2017 | |
| DE | 102016014585 | A1 | 6/2018 | |
| FR | 2842542 | A1 * | 1/2004 | E01C 19/21 |
| WO | 2013048854 | A1 | 4/2013 | |

OTHER PUBLICATIONS

China Office Action for corresponding patent application No. 2022051102529650, dated May 16, 2022, 9 pages (not prior art).
European Patent Office Action for corresponding patent application No. 20 211 156.3, dated Sep. 27, 2022, 6 pages (not prior art).

* cited by examiner

MOBILE EARTH WORKING MACHINE ENCOMPASSING A FUNCTIONAL APPARATUS PREFERABLY TOOLLESSLY COUPLED DETACHABLY TO A MACHINE FRAME

CROSS-REFERENCES TO RELATED APPLICATIONS

This application claims benefit of German Patent Application No. DE 10 2019 133 444.6, filed on Dec. 6, 2019, and which is hereby incorporated by reference in its entirety.

BACKGROUND OF THE INVENTION

1. Field of the Invention

The present invention relates to a mobile earth working machine, for instance a road milling machine, recycler, or surface miner, the earth working machine, in a reference state ready for earth-working operation, encompassing:

- a machine frame;
- a plurality of drive units, connected to the machine frame, for furnishing ground-based mobility for the earth working machine;
- a working apparatus, retained on the machine frame, for material-removing working of a region of a substrate;
- a functional apparatus that is different from the working apparatus and is connected to the machine frame pivotably movably relative to the machine frame;
- a pivot joint arrangement, arranged functionally between the machine frame and the functional apparatus, having a frame-associated joint element that is connected to the machine frame immovably relative to the machine frame, and having an apparatus-associated joint element that is connected to the frame-associated joint element pivotably by means of a pivot joint around a pivot axis relative to the frame-associated joint element and is connected to the functional apparatus.

DESCRIPTION OF THE PRIOR ART

An earth working machine of this kind is known from WO 2013/048854 A, which presents a road milling machine having a working apparatus that encompasses a milling drum, and having a transport apparatus constituting a functional apparatus. The transport apparatus is articulated on the machine frame pivotably around a pivot axis parallel to the yaw axis of the earth working machine, and serves to transport milled material away from the working apparatus.

A further road milling machine, more precisely a cold road milling machine, having as a functional apparatus a transport apparatus for transporting away milled material, i.e. removed road material, is known from U.S. Pat. No. 10,190,270 B2. Here as well, the pivot axis of the functional apparatus is yaw-axis-parallel with respect to the machine frame. This document furthermore discloses two piston-cylinder arrangements as actuators for actuator-based pivoting displacement of the functional apparatus relative to the machine frame, for instance so that a machine-frame-mounted delivery location of the transport apparatus (configured, as is usual in the industry, as a conveyor belt) can be brought toward or away from an accompanying vehicle.

The transport apparatuses for transporting removed substrate material out of the vicinity of the working apparatus can additionally be foldable around folding axes parallel to the ground, in order to reduce the dimensions of the earth working machine for transport as compared with the dimensions of the earth working machine that is operationally ready for earth working.

The outside dimensions of the earth working machine can be decreased as a result of such measures as well as a raisable and lowerable protective roof, but its weight cannot.

In many countries there is a transport weight limit which, if exceeded, requires application for a special regulatory authorization for transporting the item that is to be transported. Administrative procedures of this kind consume time and resources.

SUMMARY OF THE INVENTION:

The object of the present invention is therefore to refine the earth working machine recited previously in such a way that not only its outside dimensions but also the weight of machine constituents to be transported as an assembled unit can be appreciably decreased in rapid and uncomplicated fashion starting from a reference state of the complete machine which is operationally ready for earth working, for instance so that an authorization-free maximum transport weight for the earth working machine is not exceeded.

This object is achieved by the present invention, on an earth working machine of the kind recited previously, in that there is embodied between the machine frame and the functional apparatus a mechanical coupling structure by means of which the functional apparatus is coupled intentionally physically detachably to the machine frame; the coupling structure comprising a frame-side coupling configuration that is connected to the machine frame, and comprising an apparatus-side counterpart coupling configuration that is connected to the functional apparatus; the coupling structure being embodied with a spacing from the pivot joint in such a way that the frame-side coupling configuration and the apparatus-side counterpart coupling configuration are either both embodied on the frame-associated joint element or both embodied on the apparatus-associated joint element.

The functional apparatus can thereby be physically separated from the machine frame, so that with little effort and in a short time it is possible to create, from a single transported object that exceeds the maximum transport weight not requiring authorization, two transported objects each of which has a lower weight than the maximum transport weight not requiring authorization. The capability for immediate transport without requiring authorization more than makes up for the need for a further transport means.

The relative mobility of the two joint elements advantageously remains uninfluenced by the couplability of the functional apparatus and machine frame, since the pivot joint is not part of the coupling structure. Repeated disassembly and assembly of the pivot joint is thus superfluous. This would be more complex than the coupling, provided according to the present invention, of the functional apparatus and machine frame while maintaining the pivot joint.

If, according to a first possible embodiment of the invention, the coupling structure is arranged in the frame-associated joint element, a mass that is quantitatively as large as possible can advantageously be uncoupled from the machine frame.

If, according to a further, preferred, embodiment of the invention, the coupling structure is arranged in the apparatus-associated joint element, the mass that can be uncoupled from the machine frame is slightly less than in the first embodiment recited above, but the assembly effort for coupling and uncoupling the functional apparatus can be decreased, which more than compensates for the disadvantage in terms of mass and therefore weight. For example, detachment and connection of an accessory that is arranged on the frame side, is powered on the frame side, and spans the pivot joint, can be omitted. Such an accessory can be constituted by an actuator apparatus described below, and/or by a sensor apparatus arranged on at least one of the joint elements.

The term "joint element" refers to a physical structure proceeding functionally on one side from the pivot joint. It can be connected in one piece with the remaining relevant structure from among the machine frame and functional apparatus. For example, the frame-associated joint element can be continuous in one piece with the remainder of the machine frame. The two joint elements (frame-associated and apparatus-associated joint elements) are connected pivotably relative to one another by the pivot joint. The apportioning of the joint elements and of the actuator apparatus connecting locations recited below (articulation location and bracing location) into a frame-associated and an apparatus-associated joint element or connection location is effected with reference to the pivot axis, depending on whether a joint element or a connection location is located, with respect to the pivot axis, on the machine-frame side or on the functional-apparatus side.

The term "coupling," and terms lexically related thereto, refer to a capability for repeated intentional connection and detachment of two components or subassemblies, and/or to an intentionally detachable and re-establishable connection of two components or two subassemblies. With the exception of the joint elements and the actuator apparatus connection locations (articulation location and bracing location), the classification of further components and subassemblies as frame-side or apparatus-side refers to their location relative to the coupling structure, depending on whether the respective component or subassembly is located, with regard to the coupling structure, on the machine-frame side or on the functional-apparatus side. In the context of the substrate material conveyor as the functional apparatus, the functional-apparatus side of the coupling may be referred to as the conveyor-side of the coupling.

Because the pivot joint is located with a spacing from the coupling structure, and the coupling structure is embodied entirely in one of the joint elements, at least one joint element from among the frame-associated joint element and apparatus-associated joint element encompasses a frame-side and an apparatus-side joint element portion.

When an "operationally ready state" of the earth working machine is mentioned in the context of this Application, this refers, unless otherwise indicated in the individual case, to a state that is operationally ready for earth working as intended. If the earth working machine encompasses a transport apparatus interacting with the working apparatus, then in the aforesaid state that is operationally ready for earth working as intended, that transport apparatus is also ready for interaction with the working apparatus. The earth working machine is furthermore described, unless expressly indicated otherwise, in a reference state in which the earth working machine is ready for earth working as intended. The assumption here is that the earth working machine is standing on a flat horizontal substrate.

In order to achieve the weight-saving effect to the greatest extent possible, the functional apparatus preferably has a weight of at least one metric ton, i.e. 1000 kg, more preferably between one and five metric tons. A simultaneous reduction in the dimensions and weight of the earth working machine in preparation for transport can be achieved by the fact that the functional apparatus encompasses or is at least one substrate-material transport apparatus. With that substrate-material transport apparatus, which can encompass e.g. a conveyor belt or conveyor screw, substrate material removed by the working apparatus during earth working can be conveyed physically away from the working apparatus.

The earth working machine can comprise a multi-part transport apparatus for covering longer transport distances, for example encompassing a receiving transport apparatus, in particular a recirculating receiving conveyor belt or simply "receiving belt." The receiving transport apparatus receives removed substrate material from the working apparatus and transports it to a transfer location where it is transferred to an ejector transport apparatus, in particular a recirculating ejector conveyor belt or simply "ejector belt." The ejector transport apparatus then transports the substrate material to the aforementioned delivery location. Because, in such a case, as a rule only the ejector transport apparatus of the aforesaid transport apparatuses is connected pivotably to the machine frame, the ejector transport apparatus is preferably couplable via the coupling point for the machine frame, while the receiving transport apparatus is fixedly installed on the machine frame.

After uncoupling of the functional apparatus from the machine frame, instead of the uncoupled functional apparatus a further functional apparatus, different from the latter, can be coupled onto the remaining frame-side coupling configuration. That further functional apparatus can make the earth working machine, from which the previously functional apparatus has been removed, capable of activities for the performance of which it is not embodied in the state that is operationally ready for earth working. The functional capability of the earth working machine can thus be expanded by way of the coupling structure. For example, the further functional apparatus can encompass or be a carrying apparatus as the aforementioned functional apparatus. With the carrying apparatus, the earth working machine can, for example, carry, and transport and redeposit because of its own mobility, its working apparatus that is retained preferably detachably on the machine frame for changing between different types of working. By way of such a carrying apparatus, the working apparatus can thus be moved, in particular stowed or loaded, without further auxiliary equipment and in a manner entirely or partly detached from the machine frame, which further helps to reduce, in rapid and uncomplicated fashion and without additional extensive outlay in terms of tools and assembly, the weight of the machine frame and of the subassemblies and accessories remaining on it, constituting the largest and heaviest physical unit of the earth working machine which needs to be transported.

The working apparatus preferably encompasses or is a milling drum arranged rotatably in a transverse machine direction in a milling drum housing retained preferably replaceably on the machine frame. A preferred milling drum for earth working machines comprises a milling-drum tube on whose outer enveloping surface replaceable milling bits are received in bit holders. The bit holders, themselves preferably embodied as quick-change bit holders in order to simplify maintenance, are particularly preferably arranged helically on the enveloping surface in order to assist with the discharge of milled material.

The mobile earth working machine preferably has its own motion drive system and is thus preferably self-propelled, i.e. does not require a towing vehicle.

In principle, the pivot axis can have any orientation in space. A coupling that preferably can be established in simple fashion can be obtained by the fact that the pivot axis extends parallel to one of the Cartesian vehicle coordinate system axes, i.e. either parallel to the roll axis extending parallel to the ground in a longitudinal machine-frame direction, or parallel to the pitch axis extending parallel to the ground in a transverse machine-frame direction, or parallel to the yaw axis that extends orthogonally to the ground or to the supporting substrate of the earth working machine. The reason is that, at least along the roll axis and along the yaw axis, the machine frame is movable in respectively isolated fashion along the roll axis by the drive units or along the yaw axis by lifting units, in particular in the form of lifting columns, which preferably connect the machine frame to the drive units, and is thus easily and accurately controllable. To a limited extent this also applies to an isolated motion along the pitch axis, for example if the drive units are steerable 90° out of the straight-ahead position into a rolling direction parallel to the pitch axis, or if the earth working machine is embodied in accordance with DE 10 2016 208 246 A1.

Particularly simple coupling of the machine frame and functional apparatus is made possible by a pivot axis parallel to the yaw axis of the mobile earth working machine, since the yaw axis, in most operating states, extends approximately parallel to the effective direction of gravity. With a pivot axis parallel to the yaw axis, gravity therefore produces no, or almost no, pivoting moment acting between the joint elements connected by the pivot joint.

Because the functional apparatus, as presented above, advantageously has a large mass and is thus heavy, as a rule it is not movable only by muscle power. The earth working machine therefore preferably comprises an actuator apparatus for pivoting displacement of the apparatus-associated joint element relative to the frame-associated joint element around the pivot axis. The actuator apparatus can be, for example, an electric positioning motor or a fluid-driven piston-cylinder arrangement.

In principle, the actuator apparatus can be provided in any manner on the earth working machine. This includes the possibility that the coupling structure can extend through the actuator apparatus and that the actuator apparatus is thus divided, upon decoupling of the machine frame and functional apparatus, into a frame-side and an apparatus-side actuation apparatus part. Preferably, however, the actuator apparatus should be uninfluenced by the coupling structure in order to avoid unnecessary assembly and disassembly effort. Preferably, therefore, both a frame-associated bracing location and an apparatus-associated articulation location of the actuator apparatus are arranged on the same side of the coupling structure. The "sides" of the coupling structure are either the side of the coupling configuration or the side of the counterpart coupling configuration. Preferably, both the articulation location and the bracing location are on the side of the frame-side coupling configuration or are frame-side with respect to the coupling structure, so that upon uncoupling of the functional apparatus from the machine frame, the actuator apparatus can remain connected to its energy-supply lines and/or control lines that extend to the machine frame.

The coupling structure is preferably arranged in the apparatus-associated joint element, so that the pivot joint remains connected to the machine frame even when the functional apparatus is decoupled.

As a general principle, the coupling configuration and the counterpart coupling configuration can each comprise a flange, which flanges are connected detachably to one another, for example by a plurality of bolts or bolt/nut combinations. In order not to degrade pivot functions undesirably quickly as a result of frequent disassembly and assembly of a joint, preferably neither the coupling configuration nor the counterpart coupling configuration is a part or component of a further pivot joint provided in addition to the aforementioned pivot joint, in such a way that with the earth working machine in the operationally ready state, the coupling configuration and the counterpart coupling configuration would be connected pivotably movable relative to one another around a further pivot axis in order to execute an intended relative pivoting motion.

If the functional apparatus is pivotable relative to the machine frame around a further pivot joint in addition to the pivot joint recited above, the coupling structure is preferably arranged functionally between the pivot joint and the further pivot joint, so that after a decoupling of the functional apparatus from the machine frame, the pivot joint remains connected to the machine frame and the further pivot joint remains connected to the functional apparatus.

For example, in addition to pivotability relative to the machine frame around the yaw-axis-parallel pivot axis recited above as preferred, the functional apparatus can be tiltable around a tilt axis that is orthogonal to the pivot axis and constitutes a further pivot axis in the above sense.

Because the earth working machine as a rule comprises a tilt actuator in order to bring about in actuator-driven fashion the tilting motion of the functional apparatus relative to the machine frame around the tilt axis, it is preferred, in order to simplify and reduce the assembly and disassembly effort necessary respectively for coupling and uncoupling, if the tilt actuator is arranged entirely on the apparatus side, and remains connected to the functional apparatus even in the decoupled state. Upon coupling and uncoupling of the functional apparatus, the tilt actuator then simply needs to be respectively connected to, and disconnected from, the energy supply delivered from the machine frame. The same is correspondingly true of a signal connection between a frame-side control apparatus and the tilt actuator. This too needs to be respectively established and disconnected upon coupling and uncoupling.

The coupling configuration and the counterpart coupling configuration are, however, preferably toollessly couplable to and detachable from one another. This can be achieved, while constituting a particular secure and durable coupling connection of the machine frame and functional apparatus, by the fact that one configuration from among the coupling configuration and counterpart coupling configuration comprises a first positive-engagement structure, for instance a hook, mandrel, cup, and the like. The respective other configuration from among the coupling configuration and counterpart coupling configuration can then comprise a second positive-engagement structure, for instance a bar, rod, eye, ball, and the like. A positive engagement that physically prevents undesired disconnection can thereby be established between the first and the second positive-engagement structure. A positive engagement that acts orthogonally to the pivot axis is preferred, so that a pivoting of the two joint elements relative to one another around the pivot axis is prevented from having an undesired detaching effect on the positive engagement established between the first and the second positive-engagement structure.

According to a preferred design embodiment, the first positive-engagement structure can comprise a hook having a hook jaw that is open in the direction of the pivot axis, so that a pivoting motion of the joint elements connected to one another by the pivot joint once again can have a minimal, or no, detaching influence on the positive engagement established between the first and the second positive-engagement structure. In the case of a preferred yaw-axis-parallel pivot axis, when the hook jaw is part of the frame-side coupling configuration it preferably opens oppositely to the effective direction of gravity, so that gravity additionally assists the positive engagement between the first and the second positive-engagement structure. Conversely, if the hook is part of the apparatus-side counterpart coupling configuration, the hook jaw preferably opens (in the context of a yaw-axis-parallel pivot axis) in the effective direction of gravity in order to achieve the same assisting effect.

The second positive-engagement structure can comprise, as a mating part interacting positively with the hook, a bar portion extending transversely to the pivot axis. The bar portion preferably extends orthogonally to the pivot axis with a spacing therefrom. It is not to be excluded, however, that the bar portion has a curved profile, or deviates from strict orthogonality. "Transversely" to a reference structure means, for purposes of the present Application, closer to orthogonality than to parallelism with the reference structure.

In order to fasten the bar portion in as wide as possible a range of directions, the hook can engage around the bar portion when the machine frame and functional apparatus are in the operationally ready coupled state. The hook can, for example, engage 180° around the bar portion, so that the bar portion can automatically move, in particular slide, into the hook jaw that engages around. In order to at least make it difficult for the bar portion to slide undesirably out of the hook jaw, the motion path along which the bar portion can move into the hook jaw preferably extends at an angle from the pivot axis. In the preferred case of a yaw-axis-parallel pivot axis, the motion path of the bar portion is preferably tilted, for instance by 5° to 25°, around a tilt axis orthogonal to the pivot axis. Additionally or alternatively, the motion path can be a curved motion path whose end located closer to the hook jaw is tilted, preferably tilted in the manner indicated above, with respect to the pivot axis. In order to ascertain the tilt angle between a curved motion path and the pivot axis, the tangent to the motion path at the point of interest on the motion path in terms of the tilt angle can be utilized for that point.

The hook can already perform a certain guidance function for guiding the bar portion, and the subassembly comprising the bar portion, if the hook comprises a concave inner jaw surface which extends transversely to the pivot axis and against which a convex outer surface of the bar portion abuts in planar fashion when a positive engagement is established between the first and the second positive engagement structure. It is thereby possible to achieve a guidance surface that extends transversely, in particular orthogonally, to the pivot axis. A guidance surface of this kind can prevent or at least limit a relative tipping of the hook and bar portion, and thus of the machine frame and functional apparatus, around a tipping axis that is orthogonal both to the pivot axis and to the direction of extent, transverse in terms of the pivot axis, of the abutment region of the inner jaw surface and the outer bar-portion surface.

For defined positional orientation, in particular once again toolless position orientation, of the machine frame and functional apparatus relative to one another, one configuration from among the coupling configuration and counterpart coupling configuration can comprise an abutment structure having a, preferably exposed, abutment surface. The respective other configuration from among the coupling configuration and counterpart coupling configuration can furthermore comprise a contact structure having a, preferably exposed, contact surface. When the machine frame and functional apparatus are in the operationally ready coupled state, the abutment structure and the contact structure are in an abutting engagement with one another that acts at least in a direction extending transversely to the pivot axis. In this abutting engagement, the abutment structure and the contact surface touch one another. The normal vectors of the abutment surface and of the contact surface therefore preferably have, in a coordinate system having axial coordinates parallel to the pivot axis and having radial coordinates orthogonal to the pivot axis, a greater radial than axial component; particularly preferably, the normal vectors of the abutment surface and contact surface are oriented exclusively orthogonally to the pivot axis.

The abutment surface can have an advantageous aligning effect for relative alignment of the machine frame and functional apparatus, or of the coupling configuration and counterpart coupling configuration, if the abutment surface comprises at least two differently aligned abutment surface portions. The at least two abutment surface portions are preferably arranged with an angular spacing around the pivot axis. The different alignment is preferably an alignment in different radial directions that enclose with one another an angle around the pivot axis. The same applies to the contact surface which interacts with the abutment surface for an abutting engagement, and which comprises (for the reasons recited) at least two differently aligned contact surface portions, the at least two contact surface portions being arranged with an angular spacing around the pivot axis. This different alignment is also preferably an alignment in different radial directions that enclose with one another an angle around the pivot axis. In order to avoid axial forces that act along the pivot axis on the abutting engagement, the different alignments particularly preferably differ only in a radial alignment. The one surface portions from among the abutment surface portions and contact surface portions can thus face away from one another and/or from the pivot axis, and the respective other surface portions from among the abutment surface portions and contact surface portions can face toward one another and/or toward the pivot axis.

The coupling configuration and counterpart coupling configuration preferably encompass both the aforementioned first and second positive-engagement structure and the aforementioned abutment structure and contact structure in order to achieve a secure connection by positive engagement, and a targeted relative alignment by abutting engagement, of the coupling configuration and counterpart coupling configuration. For a stable arrangement with no undesired force feedback, it is advantageous if, when the machine frame and functional apparatus are in the operationally ready coupled state, at least one respective abutment surface portion and one contact surface portion touching it are located, with respect to a direction orthogonal to the pivot axis, on both sides of the first and the second positive-engagement structure.

In principle, the coupling configuration and the counterpart coupling configuration can be sufficient for secure and correctly aligned detachable coupling of the functional apparatus to the machine frame. In order to enhance operating reliability, the earth working machine can comprise a locking apparatus that is modifiable between a locking state in which it secures the functional apparatus, coupled to the machine frame, against detachment from the machine frame, and a release state in which it permits detachment of the functional apparatus from the machine frame.

According to a preferred design embodiment, the locking apparatus can comprise at least one displaceable locking member, such as a locking hook and/or locking stud, which is mounted displaceably on one side of the coupling structure and which, as a function of its displacement position, when considering a functional apparatus coupled to the machine frame, engages behind and/or passes through a securing configuration on the respective other side of the coupling structure.

For example, the securing configuration can be the aforementioned bar portion, and the locking member can be a closure component, which closes and opens up the aforementioned hook jaw depending on its operating position, on the hook. Additionally or alternatively, the securing configuration can be an eye or a blind hole or a passthrough opening into which the locking member, for example constituting a displaceable stud, is inserted, in particular penetratingly inserted, or from which the locking member is withdrawn, depending on the operating position of the locking member.

The at least one locking member is preferably a displaceable stud as known from DE 10 2016 014 585 A1.

Regardless of the physical embodiment of the coupling configuration and counterpart coupling configuration, the functional apparatus coupled to the machine frame can be securely locked onto the machine frame with a large locking force if the joint element that carries the locking member carries a guidance configuration on the same side of the coupling structure on which the locking member is displaceably mounted, such that the locking member also engages behind and/or passes through the guidance configuration when it engages behind and/or passes through the securing configuration on the other side of the coupling structure on the same joint element. The guidance configuration can be embodied as an eye or a passthrough opening.

According to a preferred refinement, the locking member is at least also, preferably only, displaceable along the pivot axis, so that a pivoting motion between the machine frame and functional apparatus has a minimal, or no, detaching influence on a locking state established by the locking member.

In addition to the physical and mechanical coupling of the machine frame and functional apparatus, the machine frame and functional apparatus can be coupled for the transfer of energy and/or signals. For example, the drive system of the transport apparatus and/or the aforementioned tilt actuator can require a supply of energy. The transport apparatus and/or in particular the tilt actuator can also respectively comprise one or several sensors whose detection signals must be transferred to a frame-side control apparatus. Lastly, signals must also be transferrable to the transport apparatus and/or to the tilt actuator so that their operation can be controlled from the machine frame, for instance from an operator's platform. The operation of the functional apparatus, in particular constituting a transport apparatus, can be monitored in image-sensing fashion using an electronic camera, or otherwise using suitable operating sensors. For this as well, transfer of energy and/or signals on the apparatus side is necessary. To allow this type of coupling as well to be capable of being established and undone in maximally toolless fashion, at least one electrical plug connection and/or at least one fluidic, for instance pneumatic and/or hydraulic, quick-connect coupling, can be arranged between the functional apparatus and the machine frame.

BRIEF DESCRIPTION OF THE DRAWINGS

The present invention will be explained below with reference to the attached Figures, in which.

DETAILED DESCRIPTION

Figure 1:
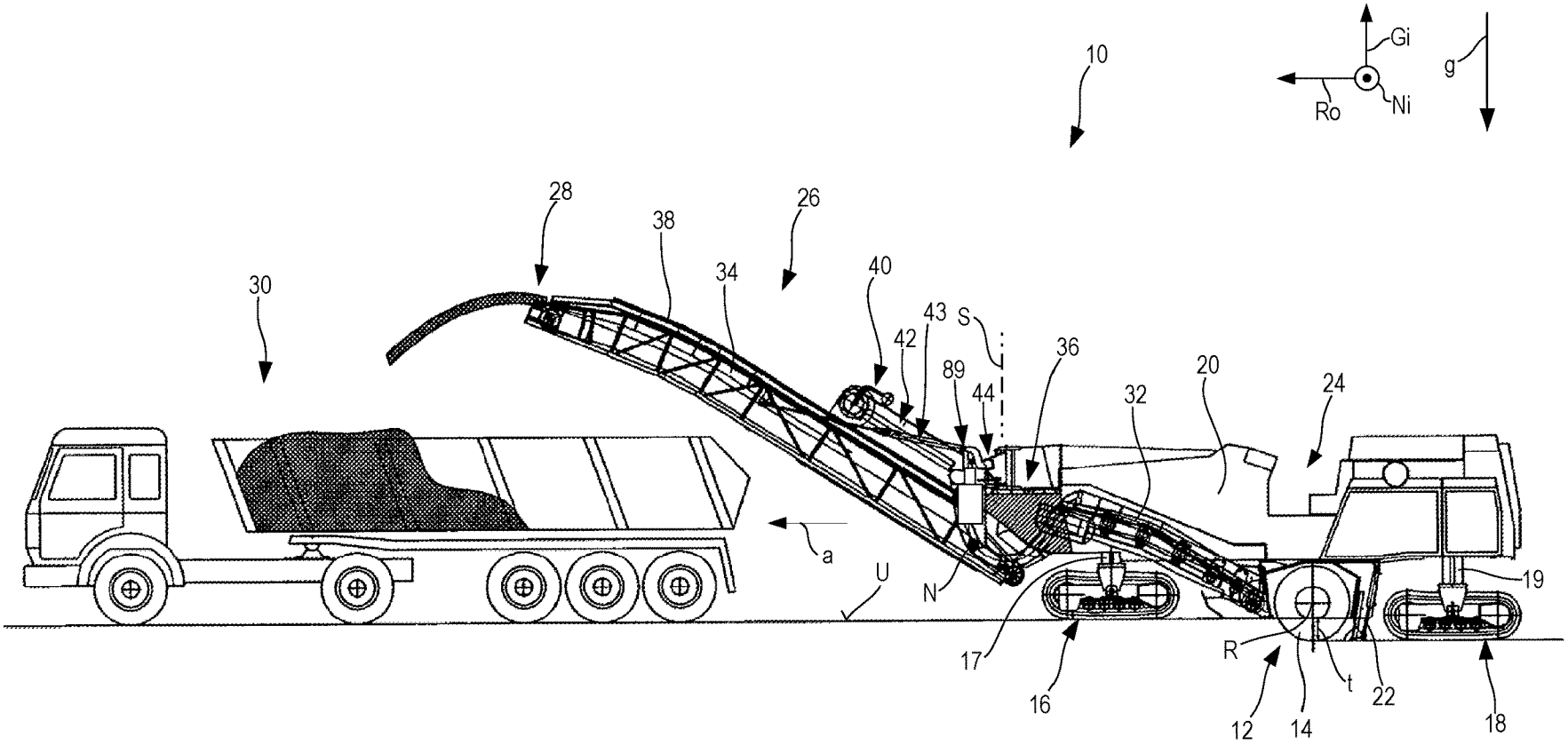
FIG. 1 schematically depicts an embodiment according to the present invention of an earth working machine during earth-working operation.

In FIG. 1, an earth working machine according to the present invention (referred to hereinafter simply as a "machine") is labeled in general with the number 10. Machine 10 according to the present invention is depicted by way of example as a large road milling machine, working apparatus 12 of which, having a milling drum 14 known per se as is typical for large road milling machines, is arranged between front drive units 16 and rear drive units 18. Drive units 16 and 18, respectively drivable preferably by a hydraulic motor (not depicted) for propelled motion, are steerable, and carry a machine frame 20 that in turn carries working apparatus 12. Machine 10 is thus a self-propelled vehicle.

The effective direction of gravity is labeled in FIGS. 1 to 3 and 5 to 8 with an arrow g.

Milling drum 14, rotatable around a rotation axis R that is orthogonal to the drawing plane of FIG. 1 and proceeds parallel to pitch axis Ni of machine 10, is shielded with respect to the external environment of machine 10 by a milling drum housing 22 that supports milling drum 14 rotatably around rotation axis R. In order to enable earth working as intended by machine 10, milling drum housing 22 is open toward the ground or substrate U, on which machine 10 stands with drive units 16 and 18 and which milling drum 14 removes.

Machine frame 20 is connected to drive units 16 and 18 via front lifting columns 17 and rear lifting columns 19, vertically adjustably along yaw axis Gi, with the result that, for example, the milling depth t of milling drum 14 is adjustable.

Machine 10 can be controlled from an operator's platform 24. Operator's platform 24 can be roofed in a manner known per se.

Substrate material removed from substrate U by milling drum 14 during earth working as intended is conveyed by a transport apparatus 26 from working apparatus 12 to a delivery location 28 where, in the example depicted, it is transferred to a transport truck 30 that, during earth working, precedes and accompanies machine 10 with a spacing in the direction of roll axis Ro. Earth working machine 10 and, in the example depicted, transport truck 30 as well, move forward in a working direction labeled by arrow a during earth working.

Transport apparatus 26 encompasses a receiving belt 32 located closer to working apparatus 12 and an ejector belt 34 that interacts with receiving belt 32 and is located farther from working apparatus 12. Receiving belt 32 is mounted on machine frame 20 in circulation-capable fashion, but unmodifiably with regard to its orientation relative to machine frame 20. At a transfer point 36, receiving belt 32 transfers the material conveyed by it onto ejector belt 34, which conveys the received material to delivery location 28. Ejector belt 34 is likewise circulation-capable but is pivotable relative to machine frame 20 around a yaw-axis-parallel pivot axis S and is preferably tiltable around a tilt axis N orthogonal to pivot axis S, so that delivery location 28, which coincides with the ejecting longitudinal end of ejector belt 34, is movable approximately over the surface of a spherical or ellipsoidal shell in order to adapt delivery location 28 to the respective accompanying vehicle. A tilt actuator 43, in the preferred form of at least one fluid-operated, preferably hydraulically operated, piston-cylinder arrangement, allows the tilt angle of ejector belt 34 to be modified from operator's platform 24.

In the example depicted, but not necessarily in principle, transport apparatus 26 is enclosed along its entire length by an enclosure 38 in order to avoid contamination of the external environment of transport apparatus 26 with dust and with material that might possibly drop off transport apparatus 26. That part of enclosure 38 which is located above receiving belt 32 is implemented for the most part by machine frame 20.

To further reduce emissions of dirt, in particular dust, from machine 10 because of working apparatus 12, the latter encompasses an extraction device 40 having a filter apparatus 42.

Ejector belt 34, constituting a functional apparatus, can be uncoupled from machine frame 20 at a coupling structure 44 in order to allow the weight of machine 10, and with the weight also its dimensions, to be reduced for transportation of machine 10.

A subassembly 45 that is on the frame side with respect to coupling structure 44 will be explained in more detail below with reference to FIGS. 2 to 4.

A protruding joint element 46 of machine frame 20 carries, as frame-associated joint elements 46, two collinear bearing stems 48 which are of identical construction in the example depicted and which define pivot axis S around which ejector belt 34 is pivotable relative to machine frame 20. Frame-associated joint element 46 can be embodied in one piece with the remainder of machine frame 20, can be connected intermaterially to it, or can be connected to it by way of separate connecting means, for example bolts and nuts.

A frame-side portion 50*a*of an apparatus-associated joint element 50 is permanently pivotably mounted on bearing stems 48. Bearing stems 48 and bearing bushings 52 engaging around them, which (in the example depicted) are advantageously embodied in one piece with frame-side portion 50*a* of apparatus-associated joint element 50, form a pivot joint 54. Pivot joint 54 exists permanently, regardless of the coupling state of machine frame 20 and of ejector belt 34 constituting the couplable functional apparatus. In the context of the substrate material conveyor as the functional apparatus, the apparatus-associated joint element 50 may be referred to as a conveyor-associated joint element 50.

Figure 2:
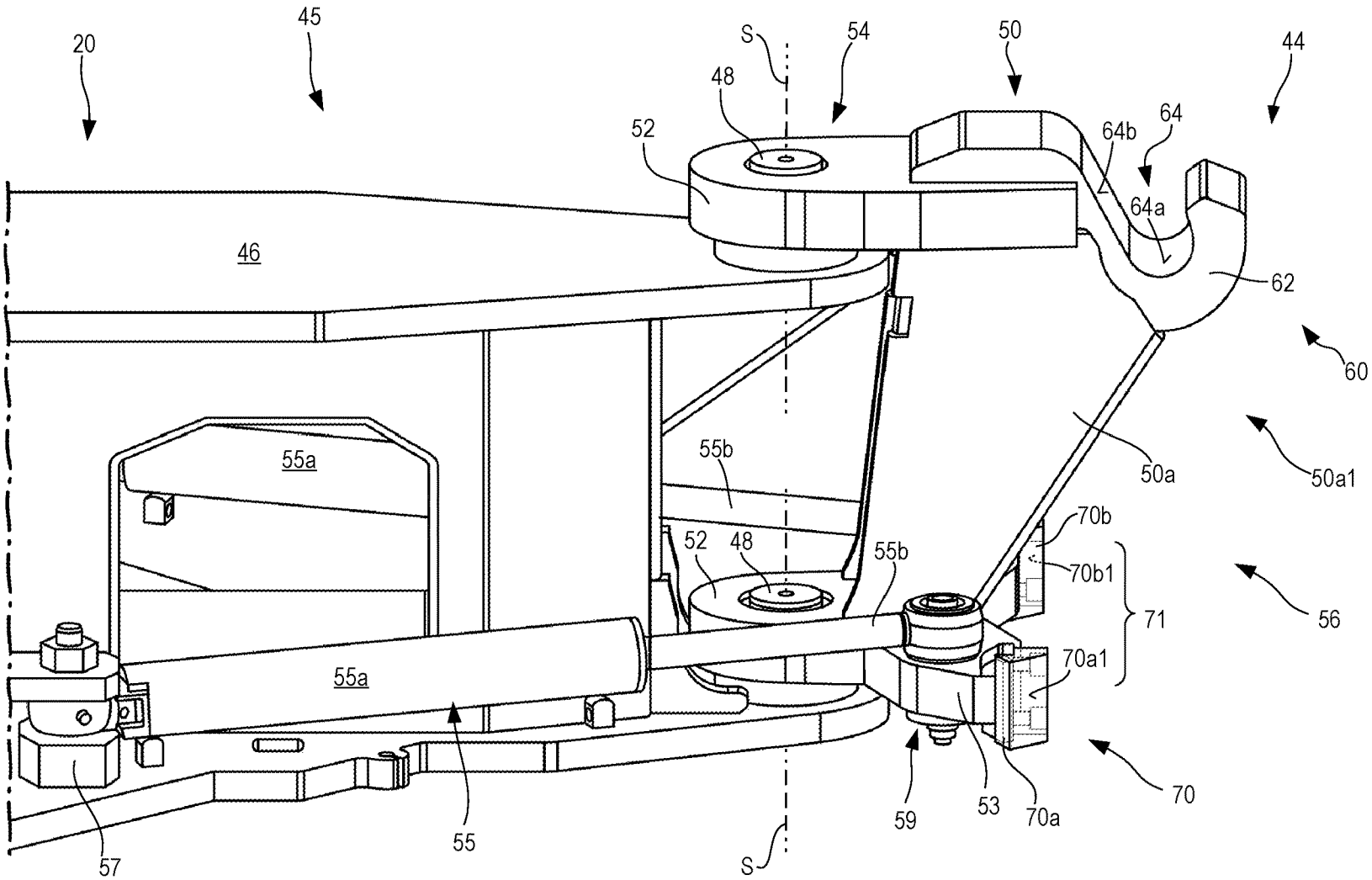
FIG. 2 is an enlarged detail view of a subassembly made up of a frame-associated joint element and a frame-side portion, connected thereto by a pivot joint, of an apparatus-associated joint element, the coupling configuration being embodied on the frame-side portion of the apparatus-associated joint element.

An apparatus-side subassembly 47 (not depicted in FIGS. 2 to 4 and partly depicted in FIGS. 5 to 8), encompassing an apparatus-side portion 50*b* of apparatus-associated joint element 50 and ejector belt 34 connected thereto, is couplable onto and uncouplable from subassembly 45 which is depicted in FIG. 2 and is on the frame side with respect to coupling structure 44.

Machine 10 encompasses, in a manner that is common to pivot axis S and pivot joint 54, an actuator apparatus 55 that is embodied, in the example depicted, as a hydraulically or pneumatically actuatable piston-cylinder apparatus. In order to exert maximally symmetrical pivoting moments in both opposite pivoting directions, actuator apparatus 55 preferably encompasses two piston-cylinder apparatuses that, when frame-associated joint element 46 and apparatus-associated joint element 50 are in an extended position, are preferably arranged mirror-symmetrically with reference to a plane of symmetry spanned by yaw axis Gi and roll axis Ro. Actuator apparatus 55 is braced on the machine frame 20 side against a frame-associated bracing location 57, and on the functional apparatus 34 side is articulated at an articulation location 59 that is apparatus-associated with respect to pivot axis S. In the example depicted, cylinder 55*a* of actuator apparatus 55 is braced against bracing location 57, and piston rod 55*b* is articulated at articulation location 59. Actuator apparatus 55 can also be installed in reverse, but it is preferred to arrange cylinder 55*a,* which needs to be supplied with fluid, closer to the frame since fluid is supplied as a rule from machine frame 20.

The entire actuator apparatus is arranged on the frame side and consequently remains unaffected by a coupling or uncoupling operation between machine frame 20 and functional apparatus 34.

Arranged at end region 50*a*1, located remotely from pivot axis S, of frame-side portion 50*a* of apparatus-associated joint element 50 is a frame-side coupling configuration 56 onto which a counterpart coupling configuration 58 (not depicted in FIGS. 2 to 4, and depicted in FIGS. 5 and 8) of apparatus-side portion 50*b* of apparatus-associated joint element 50 can be detachably, and preferably toollessly, coupled, and from which counterpart coupling configuration 58 can, again preferably toollessly, be uncoupled. In the context of the substrate material conveyor as the functional apparatus, the counterpart coupling configuration 58 may be referred to as a conveyor-side counterpart coupling configuration 58.

Coupling configuration 56 comprises as a first positive-engagement structure 60 a hook 62 having a hook jaw 64 that opens along pivot axis S and oppositely to effective direction of gravity g. In the exemplifying embodiment depicted, hook 62 has a concavely partly cylindrical inner jaw surface 64*a* that extends substantially orthogonally to pivot axis S, i.e. the cylinder axis of concavely partly cylindrical inner jaw surface 64*a* extends orthogonally to pivot axis S. Inner jaw surface 64*a* can thus, when a positive engagement is established, engage up to 180° around an (in the example depicted) convexly cylindrical outer bar surface 66*a* of a bar portion 66 (see FIGS. 5 to 8) constituting a second positive-engagement structure 68 of counterpart coupling configuration 58. When a positive engagement is established, outer bar surface 66*a* and inner jaw surface 64*a* abut in planar fashion against one another, so that the width of hook 62 defines a guidance length along which bar portion 66 is held in positionally defined fashion.

Embodied on that side of hook 62 which is located closer to machine frame 20 is an introduction surface 64*b*, in abutment against which bar portion 66 can slide into hook jaw 64. Introduction surface 64*b* is tilted relative to pivot axis S preferably around a tilt axis orthogonal to pivot axis S, so that a pivoting motion of apparatus-associated joint element 50 relative to frame-associated joint element 46 has as little detaching effect as possible on the positive engagement established between bar portion 66 and hook 62.

Coupling configuration 66 furthermore comprises an abutment structure 70, having a first abutment element 70*a* and having a second abutment element 70*b* embodied separately therefrom. The two abutment elements 70*a* and 70*b* are arranged on different sides of hook 62, and with a spacing therefrom in the direction of yaw axis Gi. Each of abutment elements 70*a* and 70*b* comprises a respective abutment surface portion 70*a*1, 70*b*1, only abutment surface 70*a*1 of abutment element 70*a* being visible in FIG. 2. Abutment surface portions 70*a*1 of abutment element 70*a* and 70*b*1 (see FIG. 4) of abutment element 70*b*, which together form an abutment surface 71, are preferably aligned parallel to pivot axis S in the example depicted and, when frame-associated joint element 46 and frame-side portion 50*a* of apparatus-associated joint element 50 are in the extended reference position, face both away from machine frame 20 along roll axis Ro and away from one another parallel to pitch axis Ni. In the aforesaid reference position, abutment surface portions 70*a*1 and 70*b*1 are arranged mirror-symmetrically with respect to the aforementioned mirror-symmetry plane spanned by roll axis Ro and yaw axis Gi.

Figure 3:
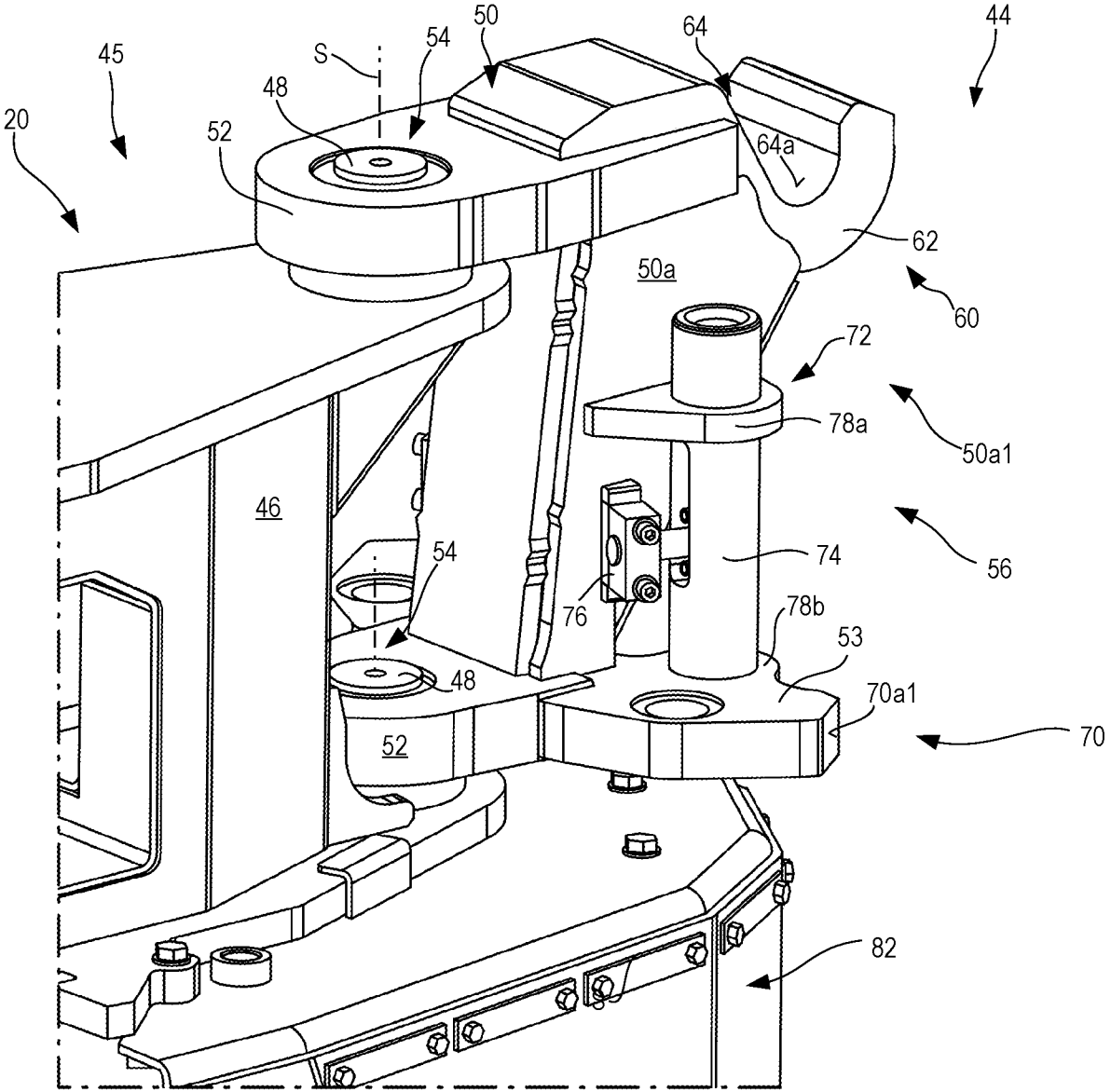
FIG. 3 shows the subassembly of FIG. 2 from a different perspective.

In FIG. 3, actuator apparatus 55 is omitted in the interest of better clarity. What is shown is a locking apparatus 72 that encompasses two locking studs 74 which are preferably displaceable along pivot axis S and which are fastened by a retainer 76 on frame-side portion 50*a* of apparatus-associated joint element 50.

Unlike what is depicted in FIG. 2, not only can abutment surface portions 70*a*1 and 70*b*1 be embodied on separate abutment elements 70*a* and 70*b* that are mounted onto a plate structure 53 on which articulation location 59 is also implemented, but abutment surface portions 70*a*1 and 70*b*1 can also be embodied in one piece with plate structure 53 of frame-side portion 50*a* of apparatus-associated joint element 50.

In each of its operating positions, i.e. regardless of its displacement state, locking stud 74 can be guided by an upper guidance configuration 78*a* and by a lower guidance configuration 78*b* arranged with a spacing along yaw axis Gi from upper guidance configuration 78*a*. Both guidance configurations 78*a* and 78*b* are embodied as eyes or as passthrough openings, which engage around the substantially cylindrical locking stud 74 along its entire circumference with a clearance fit or with a larger gap dimension than a clearance fit. Locking stud 74 is shown in FIG. 3 in its release position, in which locking apparatus 72 permits functional apparatus 34 to be coupled onto and uncoupled from machine frame 20.

Figure 4:
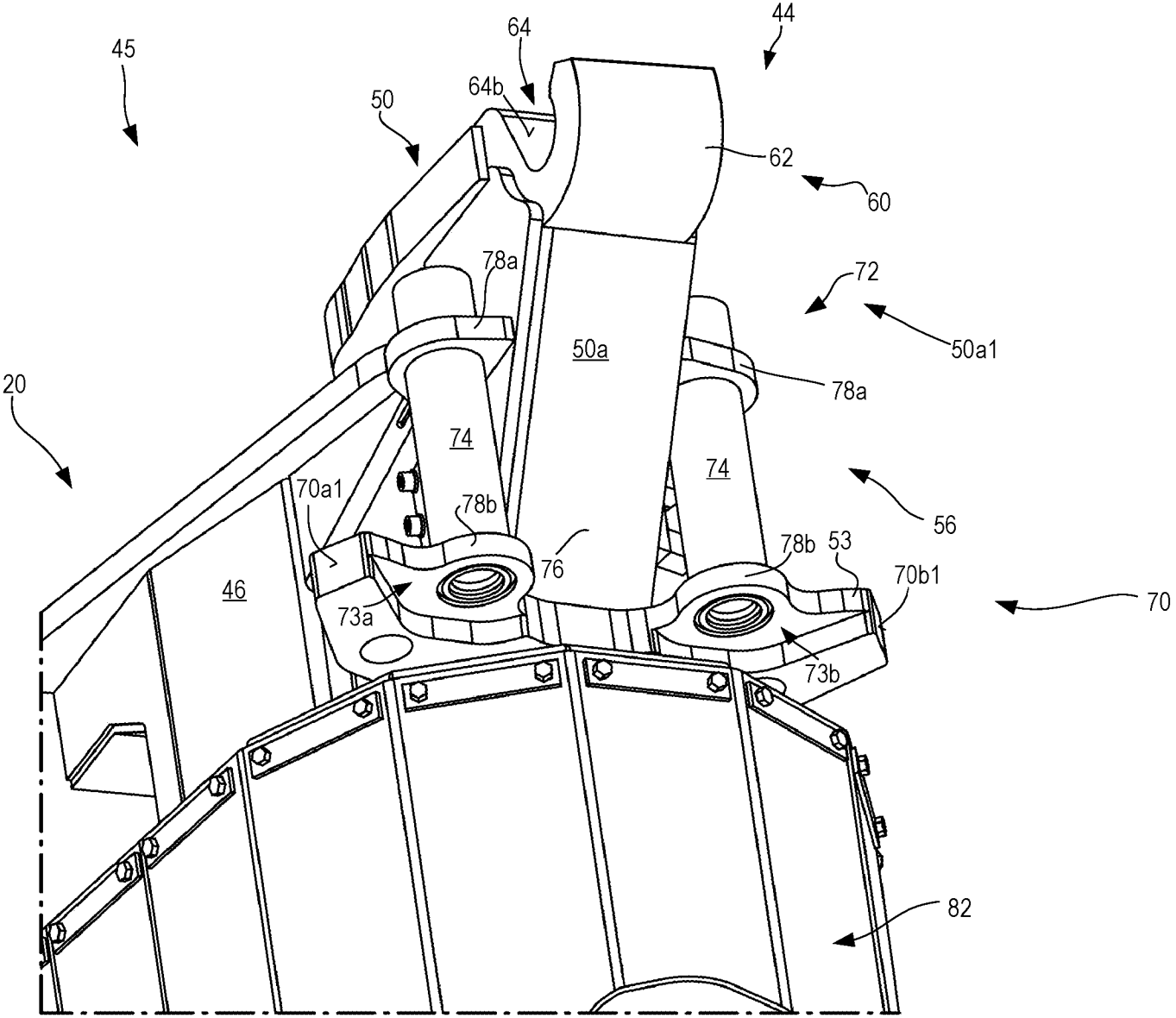
FIG. 4 shows the subassembly of FIGS. 2 and 3 from yet another perspective.

Visible in FIG. 4 on the underside of plate structure 73, associated with each locking stud 74, is a respective recess 73*a* and 73*b* in which, when machine 10 is in the operationally ready state, securing configurations 80*a* and 80*b* (see FIG. 9) are arranged in such a way that apparatus-side securing configurations 80*a* and 80*b*, embodied as eyes or passthrough openings, align with frame-side guidance configurations 78*a* and 78*b* along a line parallel to pivot axis S. In this aligned arrangement, each locking stud 74 of locking apparatus 72 can be lowered, starting from the release position shown in FIGS. 3 and 4, into its locking position in which it passes both through frame-side guidance configurations 78*a* and 78*b* and through the respective apparatus-side securing configuration 80*a* or 80*b* associated with it, and thus prevents counterpart coupling configuration 58 from pivoting relative to coupling configuration 56 around bar portion 66 received in hook jaw 64.

FIGS. 3 and 4 depict the skirt-like enclosure 82 at transfer point 36 from receiving belt 32 onto ejector belt 34.

FIGS. 5 to 8 show a coupling operation in which apparatus-side portion 50*b* of apparatus-associated joint element 50 becomes coupled, with its counterpart coupling configuration 58, onto coupling configuration 56 of frame-side portion 50*a* of the same apparatus-associated joint element 50.

The side view of FIGS. 5 to 8 depicts a contact structure 84 having contact elements 84*a* and 84*b*; contact element 84*a* conceals contact element 84*b* that is arranged with a spacing therefrom in the direction of pitch axis Ni. Both contact elements 84*a* and 84*b* are, however, visible in FIG. 9. Contact elements 84*a* and 84*b* each comprise a contact surface portion 84*a* 1 and 84*b*1, which form a contact surface 85 and are embodied for abutting engagement with abutment surface portions 70*a*1 and 70*b*1. When machine 10 is in the operationally ready state, contact surface portions 84*a*1 and 84*b*1 also extend parallel to pivot axis S, and are directed toward machine frame 20 along roll axis Ro and toward one another parallel to pitch axis Ni.

Figure 5:
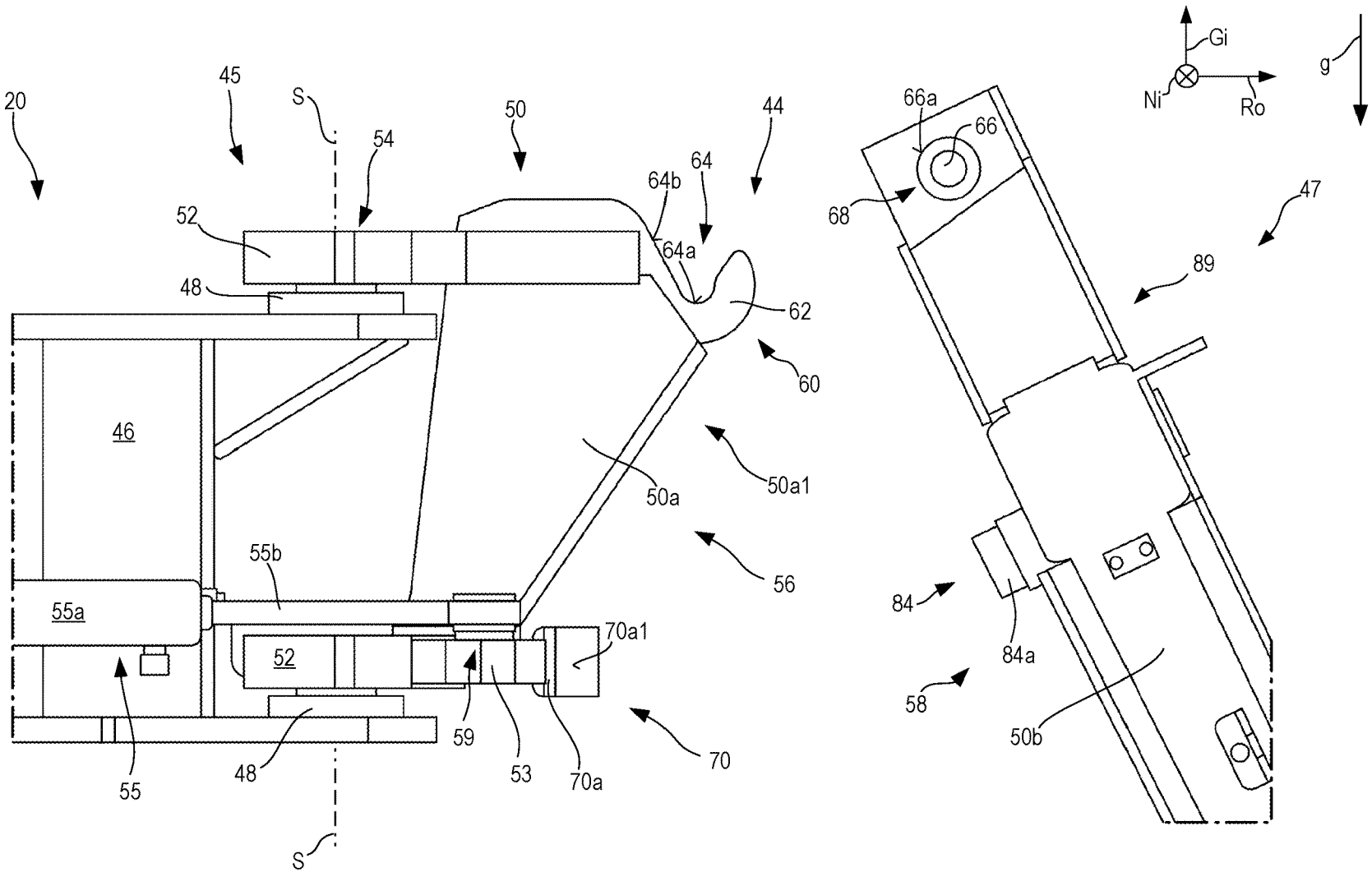
FIG. 5 is a side view of the subassembly of FIGS. 2 to 4, and of the apparatus-side portion of the apparatus-associated joint element which carries the counterpart coupling configuration, at the beginning of a coupling operation.
Figure 6:
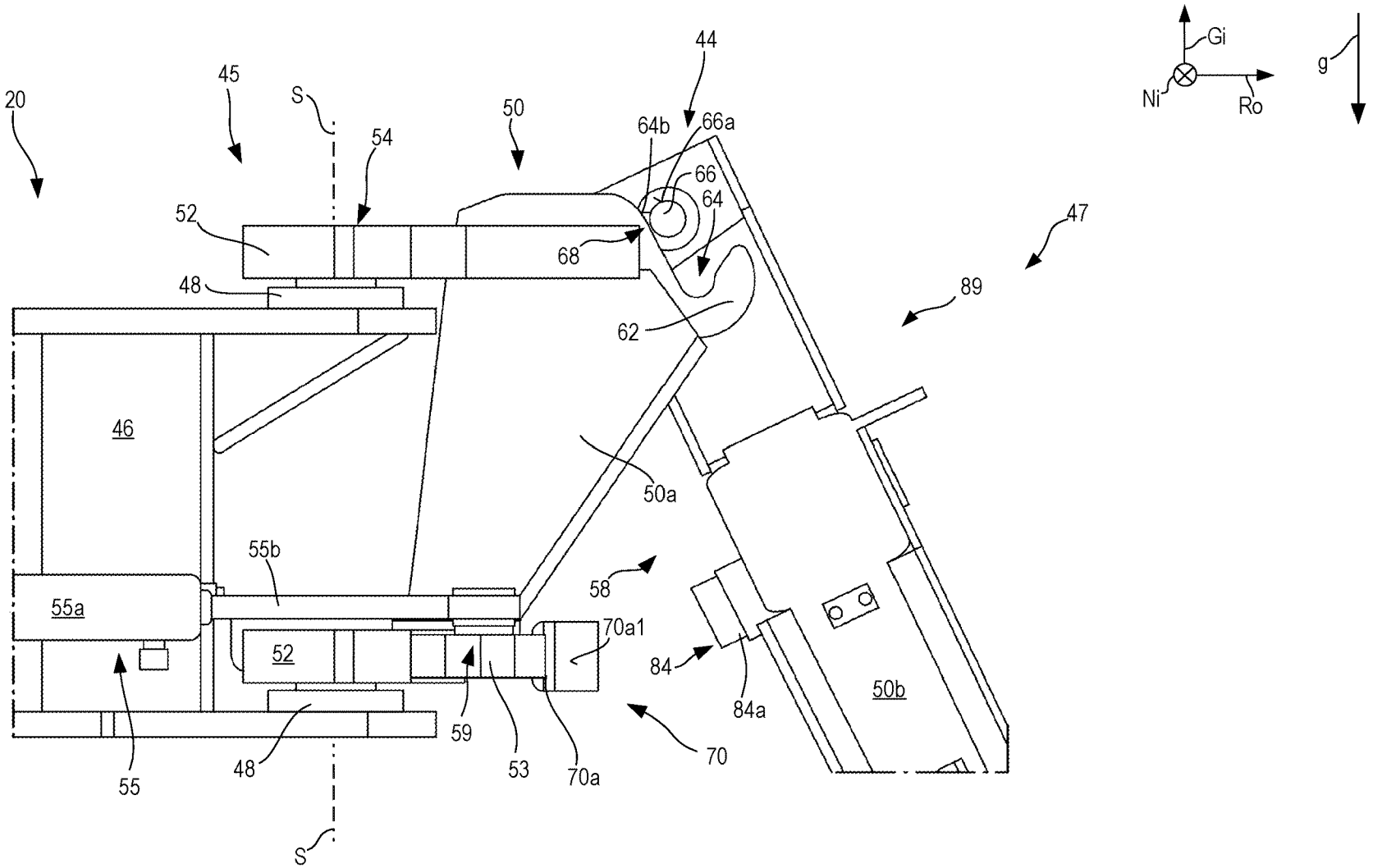
FIG. 6 shows the subassembly of FIG. 5, and the apparatus-side portion of the apparatus-associated joint element which carries the counterpart coupling configuration, after moving closer together.

Starting from the completely uncoupled state shown in FIG. 5, machine frame 20 is moved by drive units 16 and 18 toward counterpart coupling configuration 58 of the laid-down ejector belt 34 until outer surface 66*a* of bar portion 66 abuts against introduction surface (see FIG. 6).

Figure 7:
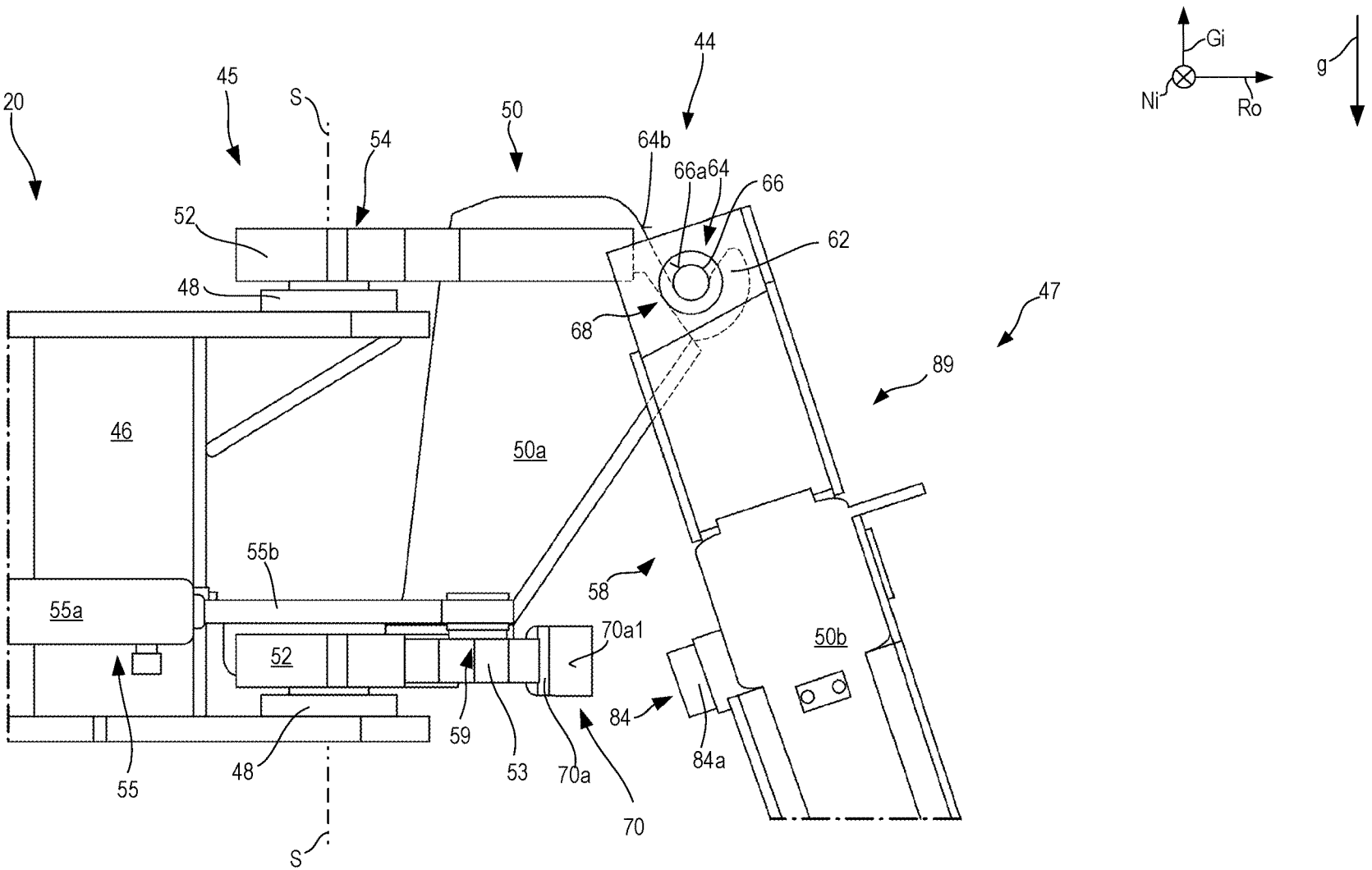
FIG. 7 shows the subassembly of FIGS. 5 and 6, and the apparatus-side portion of the apparatus-associated joint element which carries the counterpart coupling configuration, after only a positive engagement has been established between the participating positive-engagement structures of the coupling configuration and counterpart coupling configuration.
Figure 8:
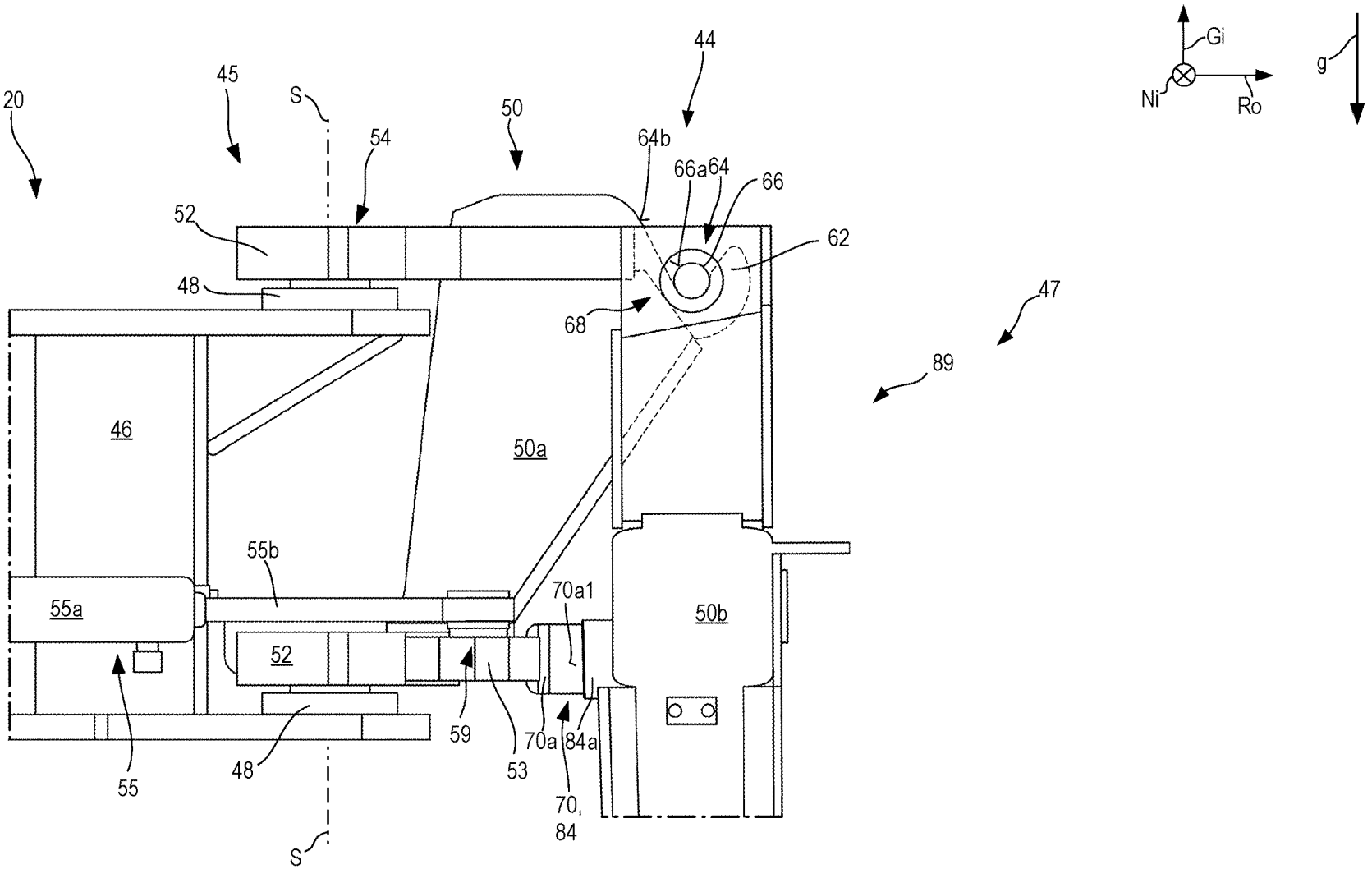
FIG. 8 shows the subassembly of FIGS. 5 to 7, and the apparatus-side portion of the apparatus-associated joint element which carries the counterpart coupling configuration, after establishment both of a positive engagement between the participating positive-engagement structures and of an abutting engagement between the participating abutment and contact structures of the coupling configuration and counterpart coupling configuration.

Machine frame 20 is then lifted, by lifting column 17 alone or columns 17 and 19, relative to the laid-down ejector belt 34 and thus relative to counterpart coupling configuration 58, so that bar portion 66 slides along introduction surface 64*b* into positive engagement in hook jaw 64 (see FIG. 7).

Starting from this completed positive engagement of positive-engagement structures 60 and 68, hook 62, and with it bar portion 66 and thus apparatus-side portion 50*b*, rigidly connected to bar portion 66, of apparatus-associated joint element 50, is raised again. If applicable, machine frame 20, in the extended reference position shown, is moved forward along roll axis Ro until, while maintaining the positive engagement between first and second positive-engagement structure 60 and 68, abutment surface portions 70*a*1 and 70*b*1 come into and remain in abutting engagement with the respective contact surface portions 84*a* 1, 84*b*1 associated with them. In this established abutting engagement, the respective securing configurations 80*a* and 80*b* align with the respective associated guidance configurations 78*a* and 78*b* of the respective locking stud 74. Locking stud 74 can then be displaced from its release position into the locking position, and thereby secures the coupling between coupling configuration 56 and counterpart coupling configuration 58, and thus between machine frame 20 and ejector belt 34 constituting the functional apparatus.

It is evident that for the entire coupling process, and likewise for the oppositely directed uncoupling process, no tool of any kind is necessary, but that coupling and uncoupling can instead be achieved solely using onboard means of earth working machine 10, encompassing machine frame 20, functional apparatus 34, and joint elements 46 and 50 connected pivotably to one another by pivot joint 54.

Figure 9:
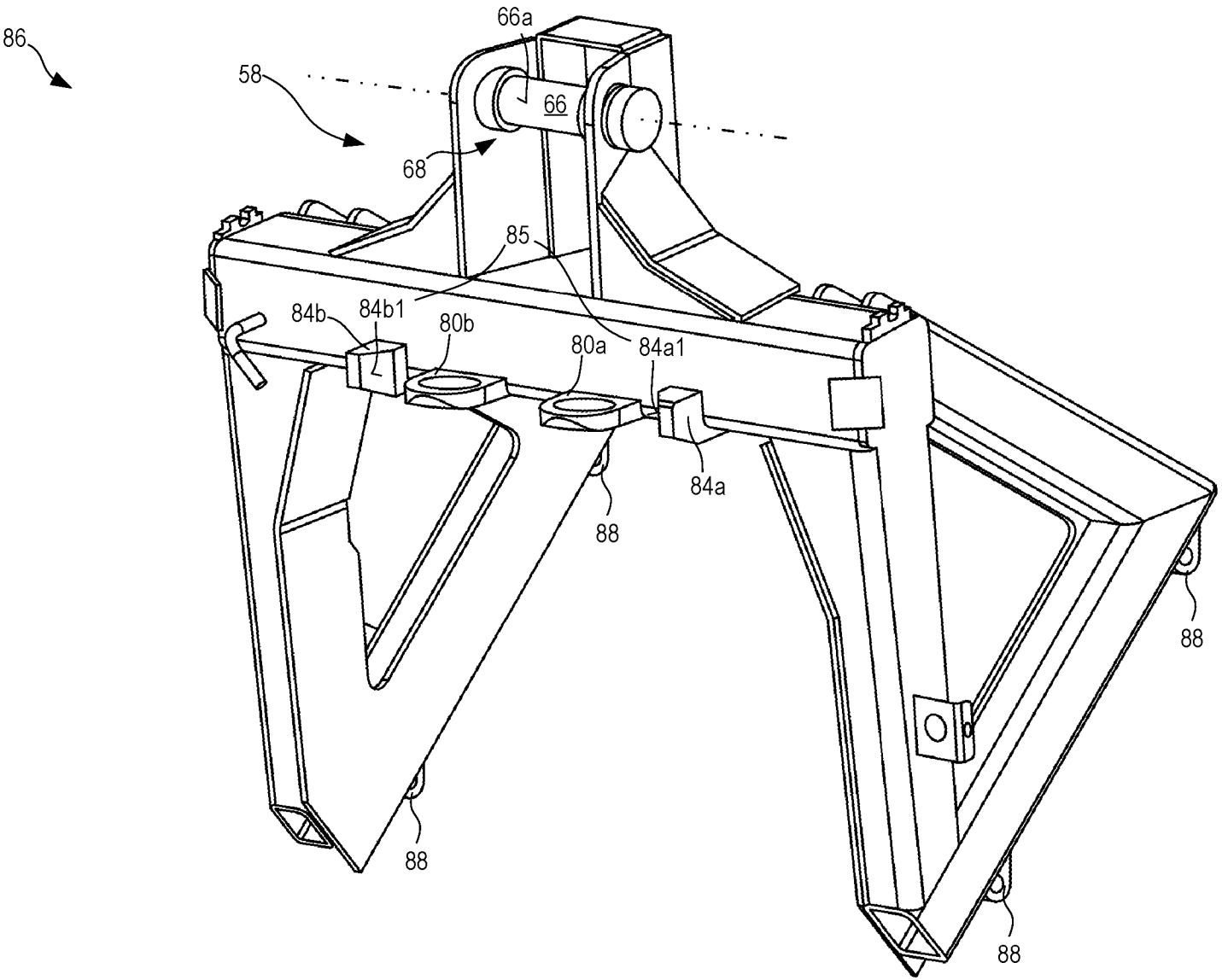
FIG. 9 is a schematic perspective view of a carrying apparatus constituting a further or alternative functional apparatus couplable to the machine frame.

FIG. 9 depicts a carrying apparatus 86 constituting a possible further functional apparatus, which is couplable via its counterpart coupling configuration 58 to coupling configuration 56. Components or subassemblies can be suspended on carrying eyes 88 of carrying apparatus 86 and can then be raised by way of the vertically adjustable machine frame 20 and moved by drive units 16 and 18. For example, earth working machine 10 can move its milling drum 14 by way of carrying apparatus 86 at least over short distances, for instance from an installation location to a transport vehicle.

Counterpart coupling configuration 58 of transport apparatus 86, encompassing bar portion 66, securing configurations 80*a* and 80*b*, and contact elements 84*a* and 84*b* having contact surfaces 84*a* 1 and 84*b*1, is embodied identically to a counterpart coupling configuration 58 of a frame 89 that constitutes part of apparatus-side subassembly 47 and carries ejector belt 34, so that what is depicted in FIG. 9 provides information not only regarding the conformation of counterpart coupling configuration 58 for carrying apparatus 86, but also regarding the conformation of counterpart coupling configuration 58 for ejector belt 34.

The invention claimed is:

1. A mobile earth working machine in a reference state ready for earth-working operation, comprising:

a machine frame;

a plurality of ground engaging drive units connected to the machine frame for moving the earth working machine across a ground surface;

a milling drum supported from the machine frame and configured to remove material from a region of a substrate;

a substrate material conveyor;

a pivot joint arrangement arranged functionally between the machine frame and the substrate material conveyor, the pivot joint arrangement including a frame-associated joint element connected to the machine frame immovably relative to the machine frame, and the pivot joint arrangement including a conveyor-associated joint element connected to the substrate material conveyor, the conveyor-associated joint element being pivotably connected to the frame-associated joint element by a pivot joint such that the conveyor-associated joint element is pivotable around a pivot axis relative to the frame-associated joint element;

a mechanical coupling arranged functionally between the machine frame and the substrate material conveyor, the mechanical coupling being configured to detachably couple the substrate material conveyor to the machine frame, the mechanical coupling including a frame-side coupling configuration connected to the machine frame and a conveyor-side counterpart coupling configuration connected to the substrate material conveyor, the mechanical coupling being spaced from the pivot joint; and a tilt actuator arranged entirely on a conveyor side of the mechanical coupling and configured to tilt the substrate material conveyor about a tilt axis orthogonal to the pivot axis.

2. The mobile earth working machine of claim 1, wherein:

the tilt actuator is connected at one end to the substrate material conveyor and at another end to the conveyor-side counterpart coupling configuration.

3. The mobile earth working machine of claim 1, wherein:

the pivot axis extends parallel to a yaw axis of the mobile earth working machine.

4. The mobile earth working machine of claim 1, further comprising:

an actuator configured for pivoting displacement of the conveyor-associated joint element relative to the frame-associated joint element around the pivot axis, the actuator being connected to the machine frame at a bracing location, and the actuator being connected to the conveyor-associated joint element at an articulation location, the bracing location and the articulation location both being on a same side of the mechanical coupling.

5. The mobile earth working machine of claim 1, wherein:

one of the coupling configuration and the counterpart coupling configuration includes a first positive-engagement structure and the other of the coupling configuration and the counterpart coupling configuration includes a second positive-engagement structure, the first and second positive-engagement structures being in a positive engagement with one another, the positive engagement acting in a direction orthogonal to the pivot axis when the machine frame and the substrate material conveyor are in an operationally ready coupled state.

6. The mobile earth working machine of claim 5, wherein:

the first positive-engagement structure is selected from the group consisting of a hook and a mandrel; and the second positive-engagement structure is selected from the group consisting of a bar and a rod.

7. The mobile earth working machine of claim 5, wherein:

the first positive-engagement structure includes a hook having a hook jaw open in a direction parallel to the pivot axis; and the second positive-engagement structure includes a bar portion extending transversely to the pivot axis, the hook engaging partially around the bar portion when the machine frame and the substrate material conveyor are in the operationally ready coupled state.

8. The mobile earth working machine of claim 7, wherein:

the hook includes a concave inner jaw surface extending transversely to the pivot axis; and the bar portion includes a convex outer surface abutting against the concave inner jaw surface when a positive engagement is established between the first and second positive-engagement structures.

9. The mobile earth working machine of claim 1, wherein:

one of the coupling configuration and the counterpart coupling configuration includes an abutment structure having an abutment surface;

the other of the coupling configuration and the counterpart coupling configuration includes a contact structure having a contact surface; and the abutment structure and the contact structure are configured such that when the machine frame and the substrate material conveyor are in an operationally ready coupled state the contact surface is in abutting engagement with the abutment surface, the abutting engagement acting at least in a direction extending transversely to the pivot axis.

10. The mobile earth working machine of claim 9, wherein:

the abutment surface includes at least two differently aligned abutment surface portions arranged with an angular spacing around the pivot axis; and the contact surface includes at least two contact surface portions arranged with an angular spacing around the pivot axis.

11. The mobile earth working machine of claim 1, further comprising:

a lock movable between a locking state securing the substrate material conveyor coupled to the machine frame against detachment from the machine frame, and a release state permitting detachment of the substrate material conveyor from the machine frame.

12. The mobile earth working machine of claim 11, wherein:

the lock includes at least one displaceable locking member mounted displaceably on one of the frame side coupling configuration and the conveyor-side counterpart coupling configuration, and the lock includes a securing configuration mounted on the other of the frame side coupling configuration and the conveyor-side counterpart coupling configuration, wherein the displaceable locking member engages behind or passes through the securing configuration when the displaceable locking member is displaced to lock the substrate material conveyor to the machine frame.

13. The mobile earth working machine of claim 12, wherein:

the displaceable locking member is displaceable parallel to the pivot axis.

14. A mobile earth working machine in a reference state ready for earth-working operation, comprising:

a machine frame;

a plurality of ground engaging drive units connected to the machine frame for moving the earth working machine across a ground surface;

a milling drum supported from the machine frame and configured to remove material from a region of a substrate;

a substrate material conveyor;

a pivot joint arrangement arranged functionally between the machine frame and the substrate material conveyor, the pivot joint arrangement including a frame-associated joint element connected to the machine frame immovably relative to the machine frame, and the pivot joint arrangement including a conveyor-associated joint element connected to the substrate material conveyor, the conveyor-associated joint element being pivotably connected to the frame-associated joint element by a pivot joint such that the conveyor-associated joint element is pivotable around a pivot axis relative to the frame-associated joint element; and a mechanical coupling arranged functionally between the machine frame and the substrate material conveyor, the mechanical coupling being configured to detachably couple the substrate material conveyor to the machine frame, the mechanical coupling including a frame-side coupling configuration connected to the machine frame—and a conveyor-side counterpart coupling configuration connected to the substrate material conveyor, the mechanical coupling being spaced from the pivot joint;

wherein:

one of the coupling configuration and the counterpart coupling configuration includes an abutment structure having an abutment surface;

the other of the coupling configuration and the counterpart coupling configuration includes a contact structure having a contact surface;

the abutment structure and the contact structure are configured such that when the machine frame and the substrate material conveyor are in an operationally ready coupled state the contact surface is in abutting engagement with the abutment surface, the abutting engagement acting at least in a direction extending transversely to the pivot axis;

the abutment surface includes at least two differently aligned abutment surface portions arranged with an angular spacing around the pivot axis;

the contact surface includes at least two contact surface portions arranged with an angular spacing around the pivot axis;

one of the coupling configuration and the counterpart coupling configuration includes a first positive-engagement structure and the other of the coupling configuration and the counterpart coupling configuration includes a second positive-engagement structure, the first and second positive-engagement structures being in a positive engagement with one another, the positive engagement acting in a direction orthogonal to the pivot axis when the machine frame and the substrate material conveyor are in the operationally ready coupled state; and when the machine frame and the substrate material conveyor are in the operationally ready coupled state at least one abutment surface portion and the contact surface portion engaging the at least one abutment surface portion are located, with respect to a direction orthogonal to the pivot axis, on each side of the first and the second positive-engagement structures.

15. A mobile earth working machine in a reference state ready for earth-working operation, comprising:

a machine frame;

a plurality of ground engaging drive units connected to the machine frame for moving the earth working machine across a ground surface;

a milling drum supported from the machine frame and configured to remove material from a region of a substrate;

a substrate material conveyor;

a pivot joint arrangement arranged functionally between the machine frame and the substrate material conveyor, the pivot joint arrangement including a frame-associated joint element connected to the machine frame immovably relative to the machine frame, and the pivot joint arrangement including a conveyor-associated joint element connected to the substrate material conveyor, the conveyor-associated joint element being pivotably connected to the frame-associated joint element by a pivot joint such that the conveyor-associated joint element is pivotable around a pivot axis relative to the frame-associated joint element;

a mechanical coupling arranged functionally between the machine frame and the substrate material conveyor, the mechanical coupling being configured to detachably couple the substrate material conveyor to the machine frame, the mechanical coupling including a frame-side coupling configuration connected to the machine frame and a conveyor-side counterpart coupling configuration connected to the substrate material conveyor, the mechanical coupling being spaced from the pivot joint; and a lock movable between a locking state securing the substrate material conveyor coupled to the machine frame against detachment from the machine frame, and a release state permitting detachment of the substrate material conveyor from the machine frame;

wherein:

the lock includes at least one displaceable locking member mounted displaceably on one of the frame side coupling configuration and the conveyor-side counterpart coupling configuration, and the lock includes a securing configuration mounted on the other of the frame side coupling configuration and the conveyor-side counterpart coupling configuration, wherein the displaceable locking member engages behind or passes through the securing configuration when the displaceable locking member is displaced to lock the substrate material conveyor to the machine frame;

the one of the frame side coupling configuration and the conveyor-side counterpart coupling configuration on which the displaceable locking member is mounted includes a guide configured such that the displaceable locking member engages behind or passes through the guide when the displaceable locking member engages behind or passes through the securing configuration.

* * * * *